United States Patent [19]

Lagsdin

[11] Patent Number: 5,050,904

[45] Date of Patent: Sep. 24, 1991

[54] STABILIZER PAD FOR EARTH MOVING APPARATUS

[76] Inventor: Andry Lagsdin, 54 King Hill Rd., Hanover, Mass. 02339

[21] Appl. No.: 530,028

[22] Filed: May 29, 1990

Related U.S. Application Data

[63] Continuation-in-part of Ser. No. 386,706, Jul. 31, 1984, abandoned, which is a continuation of Ser. No. 183,844, Apr. 20, 1988, Pat. No. 4,889,362.

[51] Int. Cl.[5] ..... B60S 9/02

[52] U.S. Cl. ..... 280/764.1; 212/189; 292/183; 292/238

[58] Field of Search ..... 280/763.1, 764.1; 212/189; 305/51, 54, 55; 292/183, 230, 238

[56] References Cited

U.S. PATENT DOCUMENTS

| | | | |
|---|---|---|---|
| 3,897,079 | 7/1975 | Mackenzie et al. | 280/764.1 |
| 3,913,942 | 10/1975 | Mackenzie et al. | 280/764.1 |
| 4,761,021 | 8/1988 | Lagsdin | 280/764.1 |
| 4,889,362 | 12/1989 | Lagsdin | 280/764.1 |

*Primary Examiner*—Andres Kashnikow
*Assistant Examiner*—Eric Culbreth
*Attorney, Agent, or Firm*—Wolf, Greenfield & Sacks

[57] ABSTRACT

Earth moving equipment especially of the loader/-backhoe type is provided with hydraulically operated stabilizer arms having associated therewith stabilizer pads. The pad is a reversible stabilizer pad having a flanged surface for engagement with gravel, for example, and a somewhat resilient surface for engagement with pavement, for example. An automatically operable sliding latch maintains the pad in a locked position but permits automatic latch disengagement for pad reversal.

19 Claims, 5 Drawing Sheets

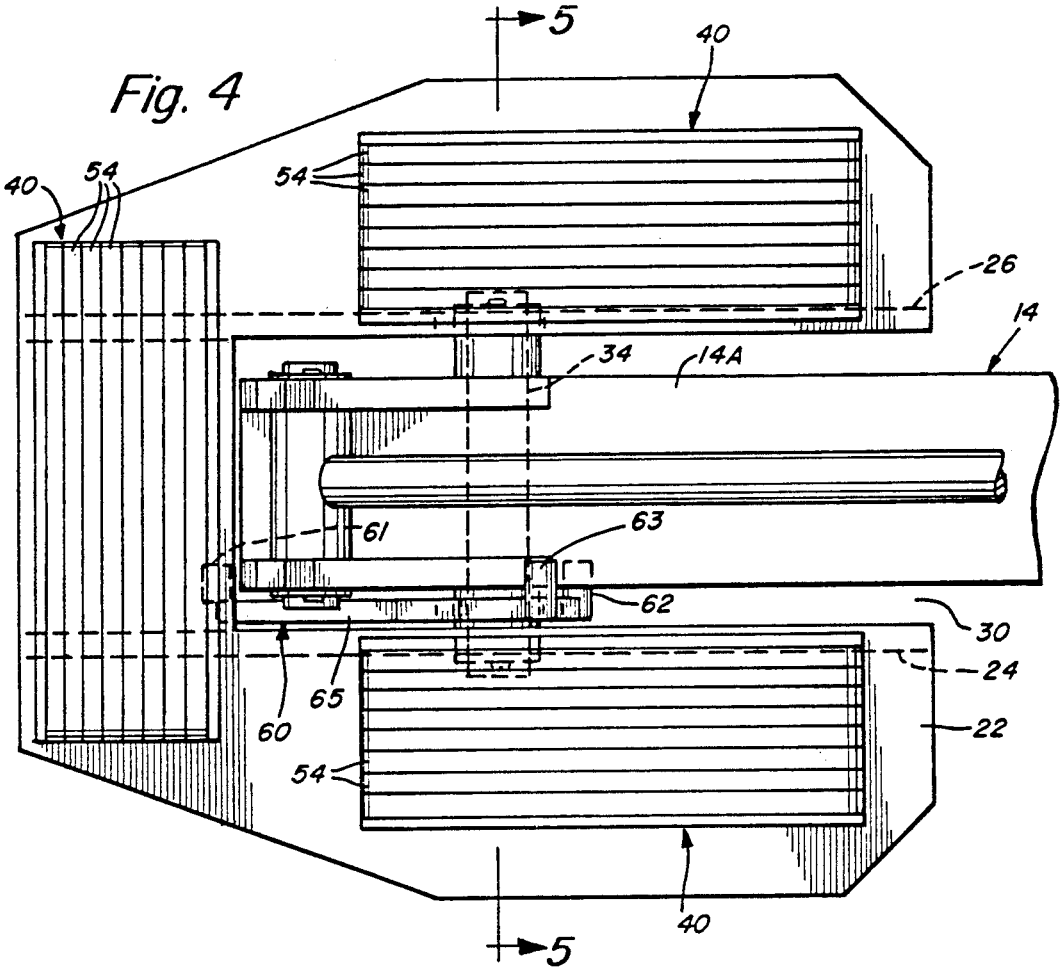
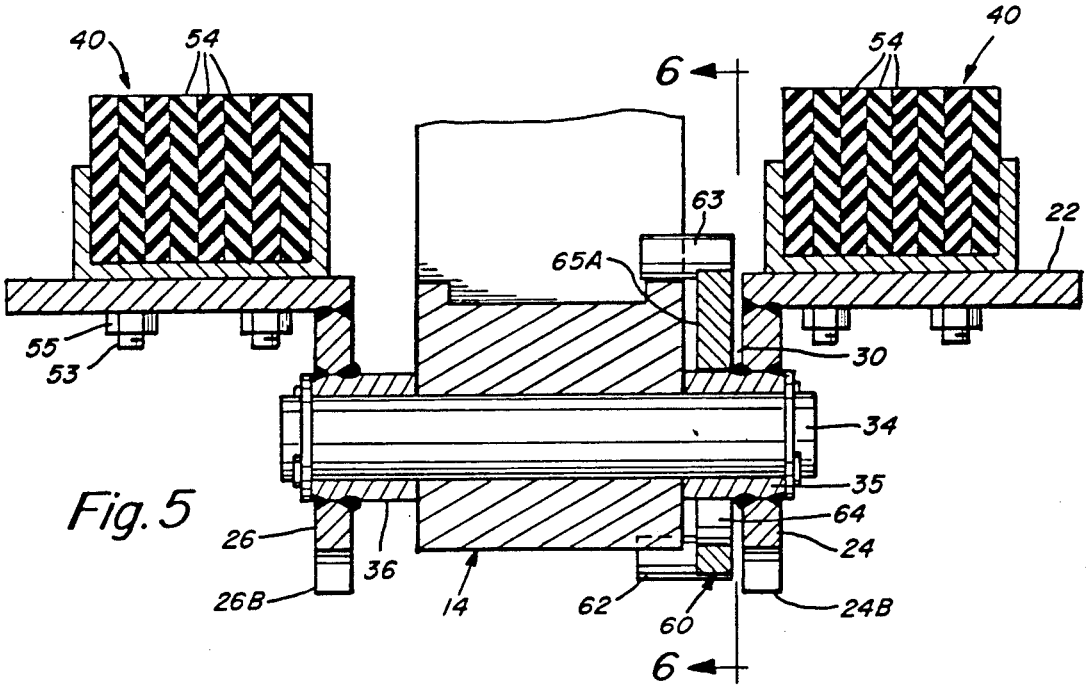
Fig. 5

STABILIZER PAD FOR EARTH MOVING APPARATUS

RELATED APPLICATIONS

This application is a continuation in part of application Ser. No. 07/386,706 filed July 31, 1989 now abandoned, which in turn is a continuation of application Ser. No. 183,844 filed Apr. 20, 1988, now U.S. Pat. No. 4,889,362 granted Dec. 26, 1989.

BACKGROUND OF THE INVENTION

1. Field of the Invention

The present invention relates in general to a stabilizer pad for use with earth moving apparatus. More particularly, the present invention is concerned with a stabilizer pad that is reversible so that it may be usable on either, for example, concrete or a more yielding surface such as dirt or gravel.

2. Background Discussion

Reference is now made herein to U.S. Pat. Nos. 3,897,079, 3,913,942 and 4,889,362 each relating to stabilizer pads for earth moving apparatus. These prior art patents illustrate a reversible stabilizer pad having a generally flanged surface for engagement with travel, for example, and a somewhat resilient surface for engagement with concrete or asphalt, for example. U.S. Pat. No. 4,889,362 describes a latching means for locking the stabilizer pad in a predetermined position. As pointed out in the background discussion of this patent, there is a tendency for the pad to self flip, particularly should the earth moving machine pad support arm be lifted. The self flipping of the pad can be remedied with the use of a securing or engaging pin or bolt that is required to be secured in each position of the pad and to be disassembled and re-secured when the position of the pad is to be changed. This becomes time consuming and furthermore may involve parts that are easily lost. The operator may also simply not bother to use the securing pin or bolt.

U.S. Pat. No. 4,889,362 addresses this self flipping problem by means of the use of an automatically operable securing latch that prevents pad self-flipping. Although the securing latch operates quite satisfactorily in accordance with the teachings in this patent, it does employ a plurality of components and is therefore somewhat costly to build and somewhat difficult to manufacture and assemble.

Accordingly, it is an object of the present invention to provide a reversible stabilizer pad for use with earth moving apparatus that is provided with an improved automatically operable securing latch that prevent pad self-flipping and is simpler and less costly to build.

SUMMARY OF THE INVENTION

To accomplish the foregoing and other objects features and advantages of the invention, there is provided an improved reversible stabilizer pad for use with earth moving apparatus or other related applications. The stabilizer pad is comprised of a plate like piece having alternate surfaces, one of which is relatively resilient and the other of which includes a flanged web, and typically a pair of spaced flanged webs for engagement with a terrain such as one of dirt or gravel. Means are provided for pivotally supporting the pad to an end of the support arm of the earth moving apparatus. The pad is rotatable relative to the earth moving apparatus support arm between alternate positions wherein either the resilient surface is facing downwardly or the flanged web surface is engaging the ground.

In accordance with a feature of the present invention, there is provided, associated with the pad, an automatically operable latch that is adapted to slide into an engagement position with the pad when the pad is engaging a ground surface, and furthermore adapted to automatically slide by gravitational force out of engagement with the pad when the arm of the earth moving machine that supports the pad is lifted. In this way when the support arm is lifted the latch disengages from the pad and the pad is easily rotated to its opposite position. The engaging and disengaging of the latch are accomplished without any operator intervention. The latch simply operates by gravitational forces to either engage or disengage from the pad depending upon the position of the support arm.

BRIEF DESCRIPTION OF THE DRAWINGS

Numerous other objects, features and advantages of the invention should now become apparent upon a reading of the following detailed description taken in conjunction with the accompanying drawings, in which:

FIG. 4 is a top plan view of the pad on the machine when in a ground or gravel engaging position;

FIG. 5 is a cross sectional view taken along line 5—5 of FIG. 4.

DETAILED DESCRIPTION

Figure 1:
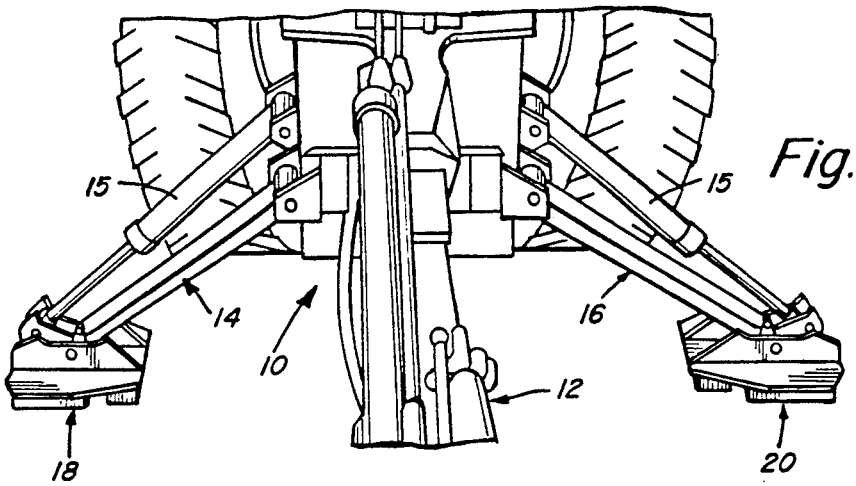
FIG. 1 is a fragmentary view of a typical loader/-backhoe having the stabilizer pads of the present invention secured thereto.

FIG. 1 is a fragmentary view of a typical loader/-backhoe 10 having a shovel mechanism 12, stabilizer arms 14 and 16, and associated stabilizer pads 18 and 20, respectively. A hydraulic piston 15 may operate each of the stabilizer 14 and 16 independently. When the equipment is being moved the pistons associated with each cylinder are withdrawn so that the support arms pivot and are thus elevated above ground level. As the arms are pivoted upwardly, it is in that position that the pads may then be reversed. When the support arms are to be used, the pistons associated with each of the cylinders are extended to the position as substantially shown in FIG. 1 for ground engagement.

Figure 2:
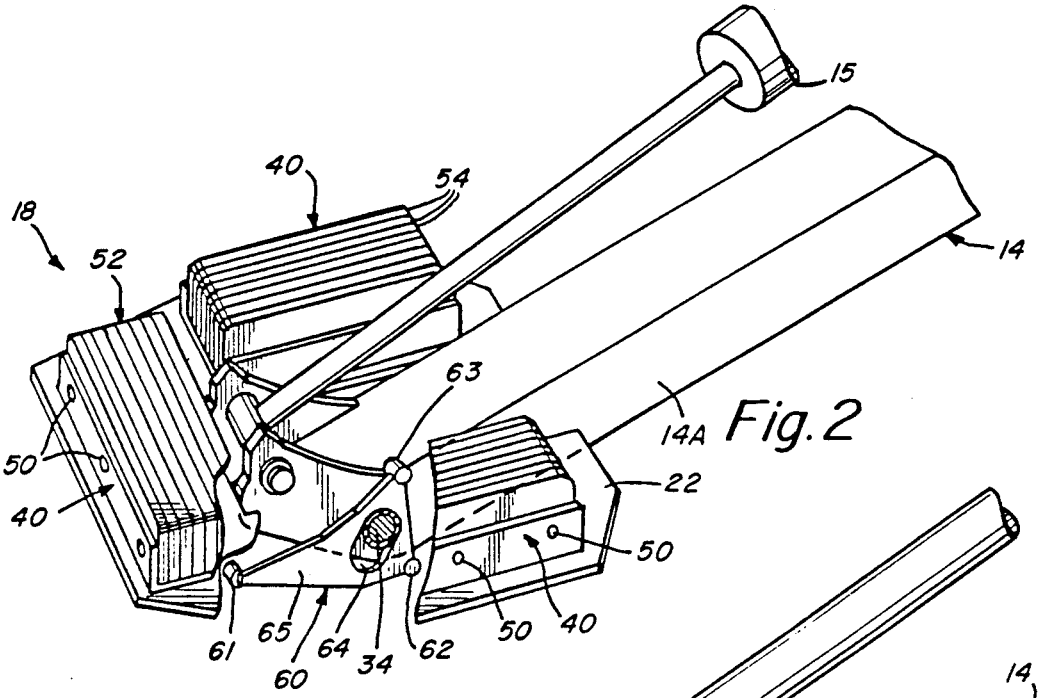
FIG. 2 is a perspective view of one of the stabilizer pads of FIG. 1 in a gravel or dirt engaging position.
Figure 3:
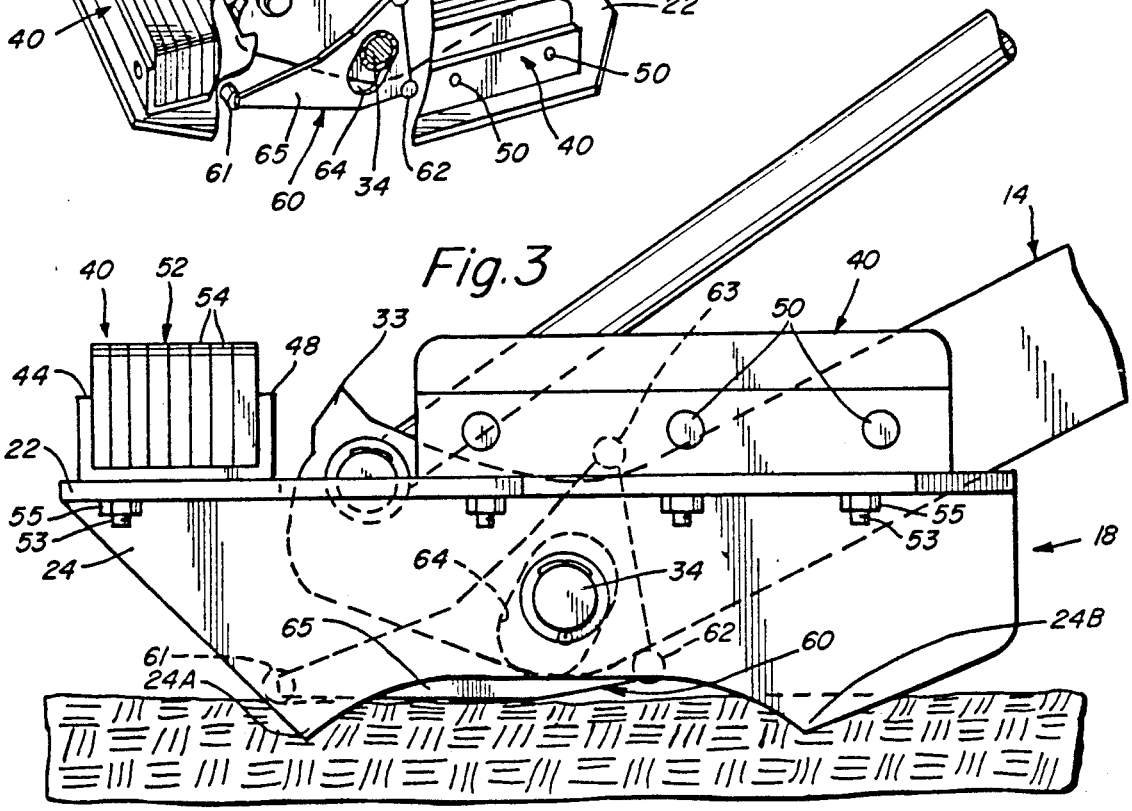
FIG. 3 is a side elevation view of the stabilizer pad construction in the position of FIG. 2.

With reference to FIGS. 2, 3 and 5, the stabilizer pad 18 includes a flat plate 22 that has extending normal to the surface thereof the flanges 24 and 26, both extending on one side from the surface of plate 22. The stabilizer pad 18 further includes the bosses 35 and 36, respectively extending normal to the surface of the flanges 24 and 26 and each extending inward toward the stabilizer arm 14. The bosses 35 and 36 each contain a hole through their center through which pin 34 fits as shown in FIG. 5.

The plate 22 is notched at 30 between flanges 24 and 26 such as is illustrated in FIG. 4 herein. The plate is notched so as to accommodate the arm 14 and to enable the reversible rotation of the stabilizer pad. The arm 14 includes a journal end for accommodating pin 34. The pin 34 may be secured in place by means of a typical cotter pin as illustrated in FIG. 3, or the pin 34 may be threaded to accommodate a nut.

FIGS. 2 and 3 also illustrate the resilient side of the reversible stabilizer pad. The resilient side of the pad is in the form of three laminated pads 40. For further description of the resilient pad construction and its method of assembly, refer to U.S Pat. No. 4,761,021.

The drawings illustrate the basic components comprising the stabilizer member resilient pad structure. This includes the angle irons 44 and 48 as illustrated in FIG. 3. Both angle irons includes a base leg and an upright leg. Each of the upright legs has holes therein for receiving the elongated securing pins 50. In this regard refer to the pins 50 in FIG. 2.

FIGS. 2 and 3 illustrate the laminate structure 52 which generally comprises a plurality of separate pieces 54 shown arranged in a sandwich or laminate array. Each of the pieces may be pre drilled with a hole to receive the corresponding pins 50.

Each of the pieces 54 is preferably made from sidewall segments of truck-tire carcasses. In this connection it is preferred not to use a steel belted tire for forming these simply because it is more difficult to cut a steel belted tire into such pieces. Each of the pieces 54 may have a thickness that is preferably on the order of $\frac{1}{4}$ inch in its uncompressed state, and preferably in the range of $\frac{1}{4}$ to $\frac{3}{4}$ inch thickness. In a typical installation 8 to 10 pieces 54 may be employed in the laminate. Of course, for larger pads then the number of pieces would be increased.

It is preferred to use segments from a truck tire so that each of the individual pieces are of proper thickness to provide proper durability and stiffness. Typically, truck tires are of 10 ply or greater. It is preferred to use a multiple ply truck tire because this provides a relatively high ratio of cord to rubber relative thickness. The thickness of the cord that provides the primary stability is preferably 4 times that of the thickness of the rubber. The greater the ply number of the tire the greater the stability of the laminate.

The laminated pads are secured to the plate 22 by means of a series of bolts 53 each having associated nuts 55 such as illustrated in FIG. 3. Once again, in connection with the fabrication of the pads 40 refer to U S Pat. No. 4,761,021.

FIG. 3 illustrates that the web 24 has two grouser points 24A and 24B. The other flanged web 26 similarly has grouser points 26A and 26B. There are thus essentially a total of 4 contact points per pad providing stability for the pad. This multipoint contact prevents rocking of the pad. It is also noted in, for example, FIG. 3 that the grouser points 24A and 24B are disposed substantially symmetrically relative to the pivot as defined by pin 34. Essentially, one grouser point is disposed on either side of the pivot 34 for enhanced stability of the reversible pad construction.

Figure 8:
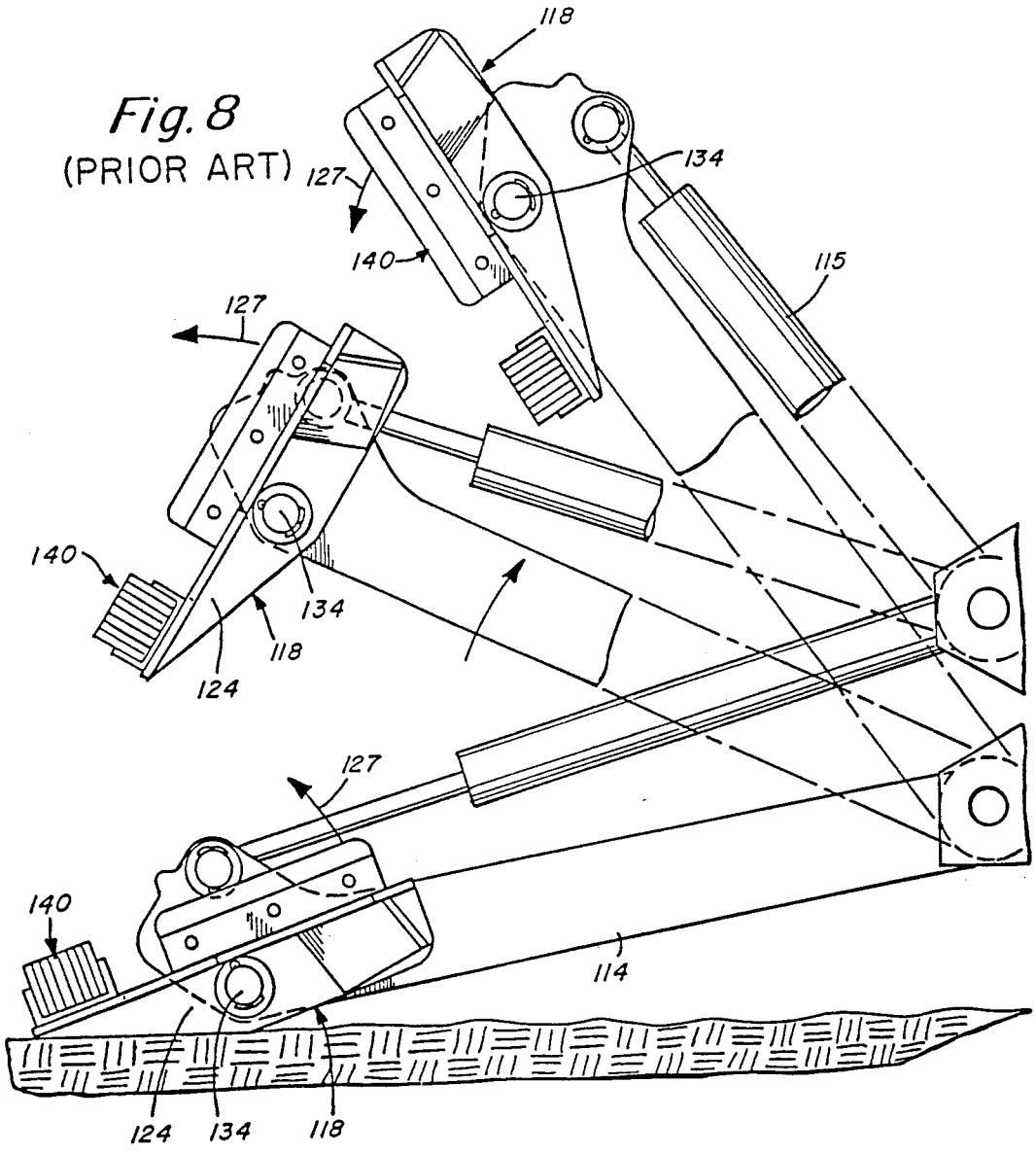
Fig. 8 (PRIOR ART)
FIG. 8 is a sequential diagram illustrating the prior art problem of pad self flipping.

To illustrate the problems of pad self flipping, refer now to the prior art drawing of FIG. 8. In FIG. 8 the apparatus is comprised of the machine support arm 114 and associated piston 115. The pad 118 is supported at pivot pin 134 from the support arm 114. The drawing also illustrates the resilient pads 140 as well as the flanged web 124.

Now, in FIG. 8 there is an illustration of a sequence of events as the support arm 114 is lifted. In the bottom position the pad is illustrated with its flanged web in contact with the ground surface. In the top position it is noted that the pad has now self-flipped so that the resilient side of the pad is facing substantially downwardly. The support arm 114 may be lifted in a rather jerky motion. Because of certain inertia that the pad has, the pad is apt to flip on its own which is not desired. Although the pad does not tend to self flip from the rubber side to the grouser side, because the rubber side of the pad is considerably heavier than the grouser side, the pad does tend to self flip from the grouser side to the rubber pad side. In this regard in, for example, FIG. 3 of the present application with the pivot being at 34, it is noted that there is considerably more weight on the pad side of the stabilizer than on the grouser side. The same also applies to FIG. 8.

In the bottom sequence of FIG. 8, the pad is shown engaging the round surface. As the arm 114 is raised, there is an inertia force in the direction of arrow 127. This same inertia force is also illustrated in the middle position illustrated in FIG. 8 wherein the pad is illustrated as now having been half-flipped upon a raising of the support arm 114. The top position in FIG. 8 illustrates the pad now completely reversed. When the arm 114 is now lowered the wrong surface will now be in engagement with the ground because the pad has now self flipped.

Figure 9:
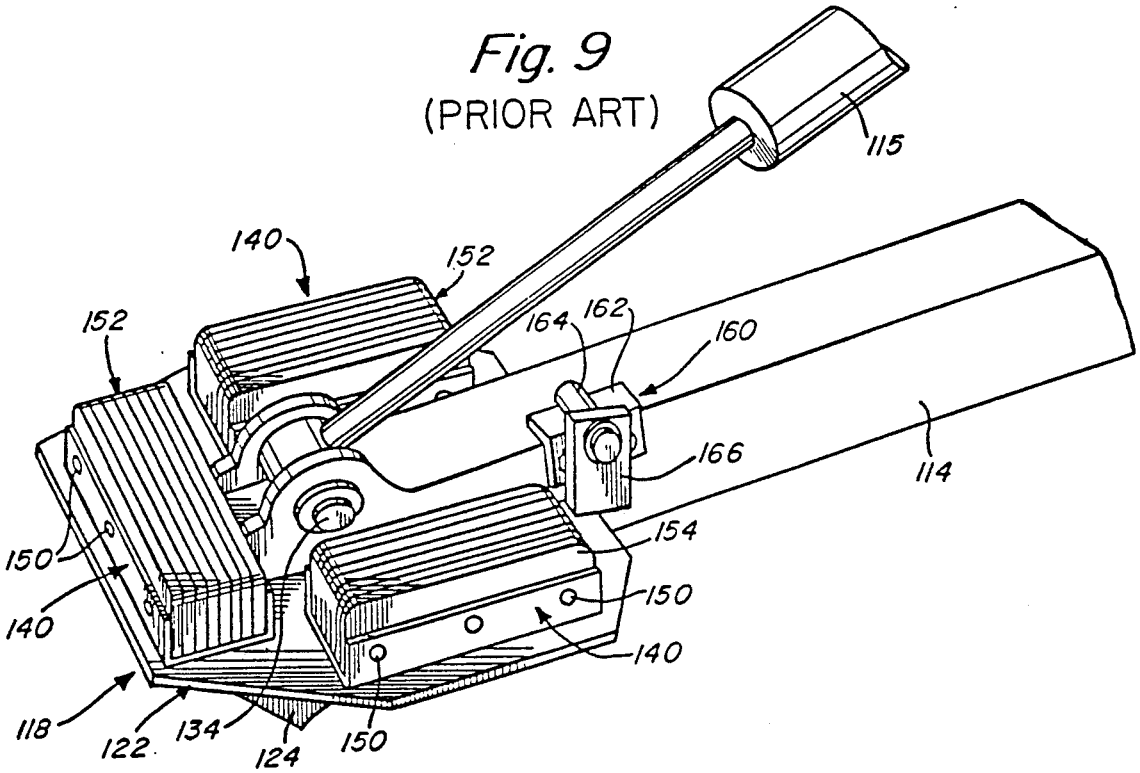
Fig. 9 (PRIOR ART)
FIG. 9 is a perspective view of the prior art showing the elements of the prior latch.

FIG. 9 illustrates a prior art latch developed to solve the self-flipping problem. For an explanation of how this latch operates, refer to U.S. Pat. No. 4,889,362. Although this latch operates satisfactorily, it requires a plurality of parts. The latch 160 includes an angle iron plate 162 secured to the arm 114, a pivot shaft 164 and a freely pivotal latch leg 166. The latch leg 166 and its support shaft 164 are freely rotatable in the member 162 and rotate under ravitational force as the arm 114 is lifted. Because of the plurality of parts, this latch 160 is costly and difficult to build.

Figure 6:
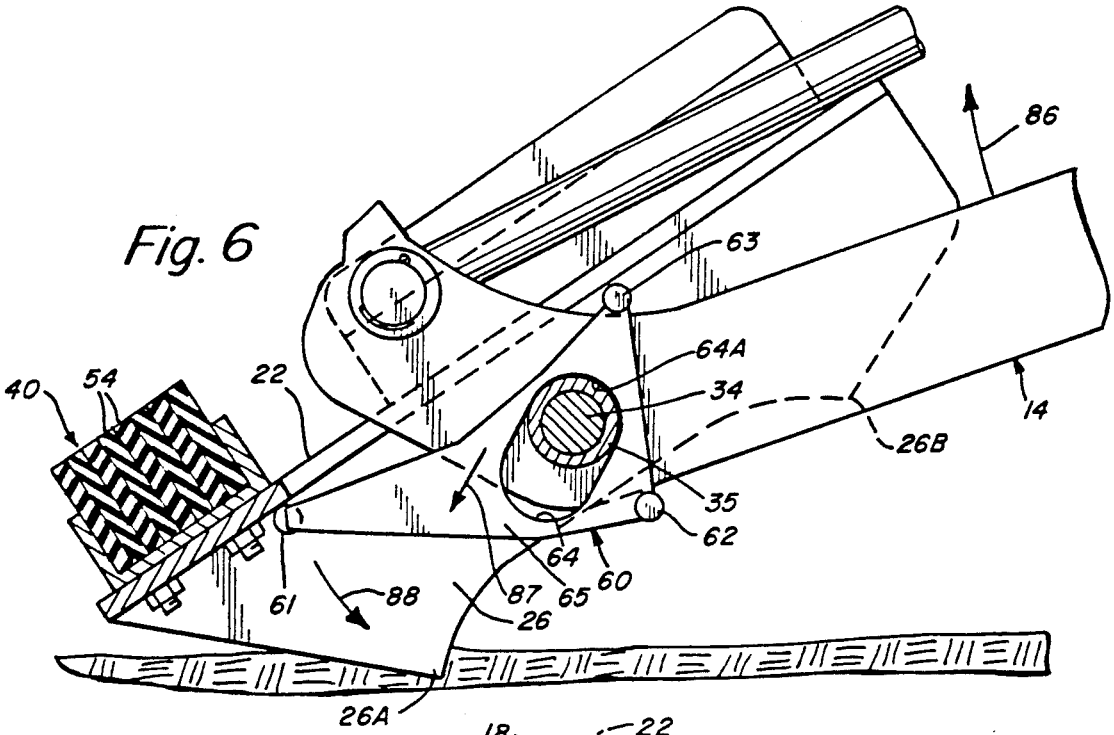
FIG. 6 is a side elevation view showing the latch engaged with the pad to prevent rotation.
Figure 7:
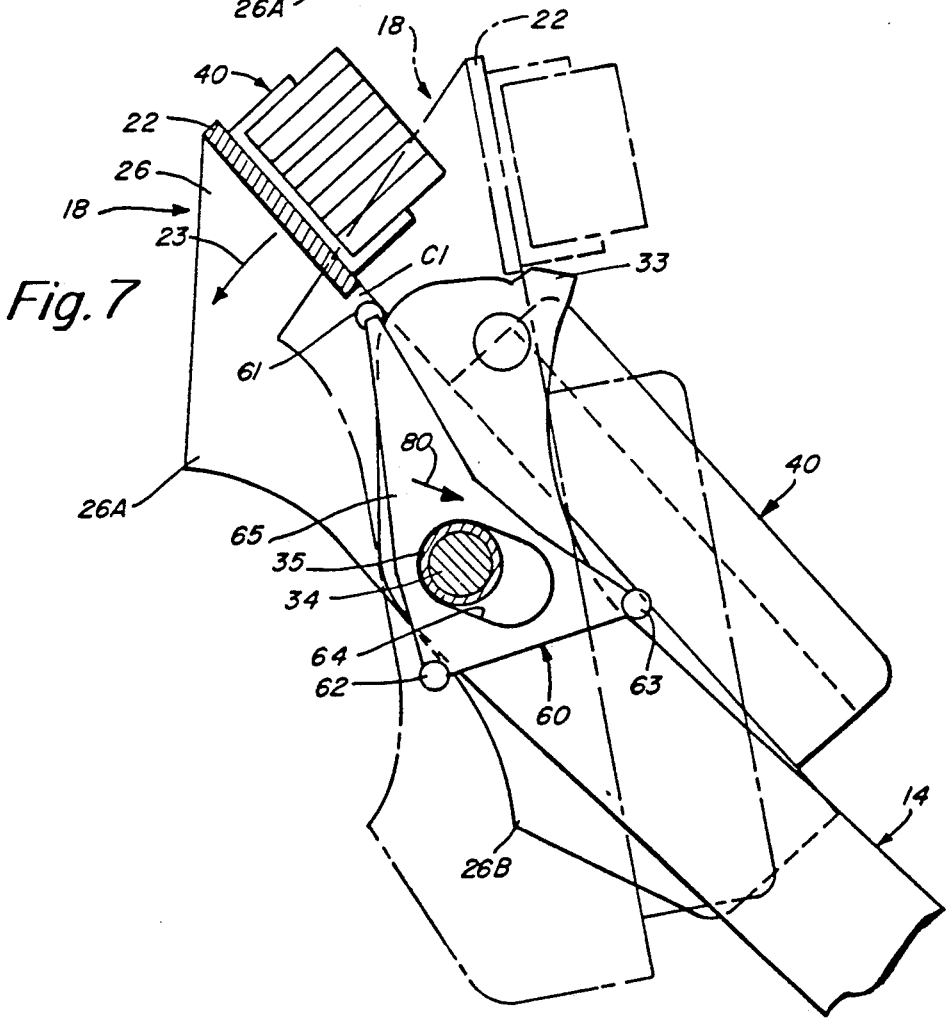
FIG. 7 is a fragmentary side elevation view showing the pad support arm in its lifted position with the latch now positioned to permit rotation of the pad and furthermore illustrating, in phantom outline, the normal, at rest, position of the stabilizer pad.

Reference is now made to the feature of the present invention in the form of a latch illustrated, for example, in FIGS. 2 and 3 and also illustrated in alternate positions in FIGS. 6 and 7. The latch 60 is a single member including a flat latch plate 65 that has extending normal to a surface 65A thereof a first latch finger 62, a second latch finger 63 and a third latch finger 61. The latch plate 65 has a latch slot 64 through which the boss 35 of the stabilizer pad 18 fits as shown in FIG. 5. As illustrated in FIGS. 4 and 5, the latch 60 is positioned within the space 30 between the arm 14 and the web 24 with the three latch fingers 61, 62 and 63 projecting inward toward the arm 14. The latch 60 is also positioned such that the first latch finger is substantially in contact with the lower surface of the arm 14 and the second latch finger 63 is substantially in contact with the upper surface 14A of the arm 14.

In FIG. 6 the third latch finger 61 is illustrated in engagement with the plate 22 of the stabilizer pad. In this position, as the arm 14 is lifted through low lift angles in the direction of arrow 86, the latch 60 stays in engagement with the stabilizer pad and prevents flipping thereof. With the arm 14 in this substantially lowered position, a force due to gravity operates in the direction shown by arrow 87 to slide the latch 60 into the position shown in FIG. 6. In this position the pin 34 engages the edge 64A of latch plate 65 that defines the slot 64. In this position, the third latch finger 61 is in contact with the plate 22 of the stabilizer pad. As the arm 14 is raised, gravitational force operates on the stabilizer pad 18 in the direction shown by arrow 88. Counterclockwise rotation of the pad is prevented because the third latch finger 61 contacts plate 22 of the stabilizer pad. Counterclockwise rotation of the stabilizer pad 18 and the latch 60 as a unit is prevented because the first latch finger 62 contacts the arm 14 thereby preventing counterclockwise rotation.

As the arm is lifted to the position of FIG. 7, gravitational force causes the latch 60 to slide in the direction shown by arrow 80. When the latch has slid into the position shown in FIG. 7, clearance Cl is provided between the third latch finger 61 of the latch 60 and the plate 22 of the stabilizer pad. When this clearance is provided, the pad can be pivoted to its opposite position. The arrangement of the present invention is such that one can essentially lock the pad in position without requiring the manual insertion of a pin or the like. When the arm is moved upwardly, the latch automatically disengages after substantial raising of the arm and the pad can be pivoted.

FIG. 7 illustrates in phantom the normal at rest position of the stabilizer pad with the arm up. In this regard, it is noted that there is provided a stop at 33 that contacts the pad to limit clockwise rotation of the resilient pad as viewed in FIG. 7. FIG. 7 also illustrates by arrow 23 the direction of rotation of the pad about its pivot 34. Because of the clearance provided, the pad can be flipped to its opposite side with the resilient pad construction now for engagement with a pavement, also referred to as the street side of the pad. In this position, the arm 14 itself functions to limit the counterclockwise rotation of the reversible pad. In the particular embodiment disclosed herein, the latch does not operate or contact the pad in the street side position of the pad as indicated previously. The street side pad position of the stabilizer is the heavier side, and thus there is no tendency towards self-flipping in this particular embodiment, and thus in the disclosed embodiment the latch does not operate or contact the pad. However, in an alternate embodiment of the invention, the latch could be constructed to contact the stabilizer in either position.

In the present embodiment of the invention it is preferred that the orientation of the latch 60 be maintained in relation to the arm 14 as illustrated, for example, in FIG. 6. The axis of the latch plate 65 running from the latch slot 64 to the third latch finger 61 is parallel to and in substantially the same direction as the axis of the arm 14 running from the loader/backhoe 10 to the stabilizer 18. This orientation is preferred because of the dimensions of the latch plate 65 in the present embodiment. If this relation were not maintained, sufficient clearance might exist between the latch 60 and plate 22 of the stabilizer pad to allow the pad to self flip even when the arm 14 was in a lowered position. In the present embodiment of the invention the proper orientation of the latch 60 is maintained by the positioning of latch fingers 62 and 63 relative to the arm 14. As previously described, latch finger 62 is substantially in contact with the lower surface of the arm 14 thereby preventing counterclockwise rotation of the latch 60 relative to the arm 14. Similarly, latch finger 63 is substantially in contact with the upper surface 14A of the arm 14 thereby preventing clockwise rotation of the latch 60 relative to the arm 14.

A further feature of the present invention is illustrated in FIG. 3. When the flanged surface of the stabilizer pad contacts the ground, the flanges 24 and 26 extend below the ground surface and the latch 60 contacts the ground as shown in FIG. 3. As the flanges are lowered below ground level, the force exerted by the ground on the latch 60 causes the latch 60 to slide partially upward as shown in FIG. 3. This upward sliding is desired to prevent the latch 60 from being crushed between the ground and the stabilizer 18.

Having now described a limited number of embodiments of the present invention, numerous other embodiments and modifications thereof should now be contemplated as falling within the scope of the present invention as defined by the appended claims.

What is claimed is:

1. For an earth moving apparatus having at least one support arm, a stabilizer comprising a plate-like piece having alternate surfaces one of which is resilient and the other of which includes a flanged web, support means for pivotably supporting said piece to an end of said support arm, said piece being rotatable relative to said support means between alternate positions wherein either said resilient surface is facing downwardly or said flanged web is engaging the ground, and latch means including a freely slidable latch member adapted to operate under gravitational force to lock said piece in a predetermined position when said support arm is down and to slideably move to disengage from said piece when said support arm is lifted so as to enable manual pad reversal.

2. An apparatus as set forth in claim 1 wherein said latch member slides relative to said support arm.

3. An apparatus as set forth in claim 2 including means for inhibiting rotation of said latch member relative to said support arm.

4. An apparatus as set forth in claim 1 wherein saod latch member includes a latch plate having means defining a slot therein, said support means fitting through said latch slot thereby supporting said latch member.

5. An apparatus as set forth in claim 4 wherein said latch member is positioned between said support arm and said stabilizer.

6. An apparatus as set forth in claim 5 wherein said latch member includes a first latch finger normal to and extending from a first surface of said latch plate for contacting said support arm to prevent rotation in a first direction of said latch member relative to said support arm.

7. An apparatus as set forth in claim 6 wherein said latch member further includes a second latch finger normal to and extending from a first surface of said latch plate for contacting said support arm to prevent rotation in a second direction of said latch member relative to said support arm.

8. An apparatus as set forth in claim 7 wherein said latch member slides partially upward when said flanged web engage the ground.

9. An apparatus as set forth in claim 8 wherein said latch member includes a third latch finger normal to and extending from the first surface of said latch plate for contacting said piece when said support arm is down.

10. An apparatus as set forth in claim 1 wherein said latch member includes means for support from said stabilizer piece support means.

11. An apparatus as set forth in claim 10 wherein said latch member has means defining a slot for providing support thereof from said stabilizer piece support means.

12. An apparatus as set forth in claim 11 wherein said slot is elongated, said stabilizer piece support means comprising a support pin fitting in said elongated slot, said elongated slot enabling limited sliding of said latch member.

13. An apparatus as set forth in claim 12 wherein said latch member has means for engagement of the latch member with the support arm for preventing any substantial relative rotation therebetween while enabling limited sliding therebetween.

14. An apparatus as set forth in claim 1 wherein said latch member has means for engagement of the latch member with the support arm for preventing any substantial relative rotation therebetween while enabling limited sliding therebetween.

15. An apparatus as set forth in claim 14 wherein said means for engagement comprises a plurality of support fingers.

16. An apparatus as set forth in claim 15 wherein said latch member comprises a latch plate and said plurality of fingers extend in a direction substantially normal to the plane of said latch plate.

17. An apparatus as set forth in claim 16 wherein said latch plate has a substantially triangular shape with the support fingers disposed respectively at the apex of the triangular shape.

18. An apparatus as set forth in claim 17 wherein one of said support fingers is adapted for engagement by the plate like piece to prevent rotation thereof.

19. An apparatus as set forth in claim 18 wherein the other two of said support fingers are extending on opposite surfaces of the support arm for engagement therewith.

* * * * *